US010151103B1

(12) United States Patent
Hohmann, Jr.

(10) Patent No.: US 10,151,103 B1
(45) Date of Patent: Dec. 11, 2018

(54) FACADE SUPPORT SYSTEM

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 15/797,737

(22) Filed: Oct. 30, 2017

(51) Int. Cl.
*E04B 1/41* (2006.01)
*E04F 13/14* (2006.01)

(52) U.S. Cl.
CPC ..... *E04B 1/4178* (2013.01); *E04F 13/14* (2013.01)

(58) Field of Classification Search
CPC E04F 13/14; E04F 13/22; E04F 13/24; E04B 1/4178; E04B 1/38; E04B 1/7629
See application file for complete search history.

(56) References Cited

U.S. PATENT DOCUMENTS 3,102,614 A * 9/1963 Lydard ..... E04B 9/16 248/228.7
3,130,821 A * 4/1964 Dunlap ..... E04B 9/16 403/398
8,375,667 B2 * 2/2013 Hohmann, Jr. ..... E04B 1/4185 52/379
8,726,596 B2 5/2014 Hohmann, Jr.
8,726,597 B2 5/2014 Hohmann, Jr.
8,839,581 B2 9/2014 Hohmann, Jr.
8,881,488 B2 11/2014 Hohmann, Jr. et al.
8,898,980 B2 * 12/2014 Hohmann, Jr. ..... E04B 1/4178 52/379
8,904,726 B1 * 12/2014 Hohmann, Jr. ..... E04B 1/4178 52/379
8,904,727 B1 12/2014 Hohmann, Jr.
8,978,330 B2 3/2015 Hohmann, Jr.
2011/0146195 A1 * 6/2011 Hohmann, Jr. ..... E04B 1/4178 52/713
2013/0232909 A1 * 9/2013 Curtis ..... E04B 1/4178 52/704
2014/0352250 A1 * 12/2014 Karabas ..... E04G 21/122 52/712

OTHER PUBLICATIONS

Hohmann & Barnard, Inc., Veneer Anchors 2-Seal™ Tie, www.h-b.com, © 2013-2017 MiTek, (1) pg.

(Continued)

*Primary Examiner* — Beth A Stephan
(74) *Attorney, Agent, or Firm* — Stinson Leonard Street LLP

(57) ABSTRACT

A veneer tie for use in a wall to join a veneer wall to an inner wall. The veneer tie includes an attachment portion and an insertion portion. The attachment portion has a bent loop defining an opening configured to receive a fastener to secure the attachment portion to the inner wythe and a circumferential discontinuity located on the loop. The discontinuity has a width that is less than a width of the opening. The insertion portion is fixed to the attachment portion and extends in a direction transverse of the attachment portion. The insertion portion is configured for attachment to the veneer wall.

18 Claims, 11 Drawing Sheets

(56) References Cited

OTHER PUBLICATIONS

Hohmann & Barnard, Inc., Gripstay™ Anchors, Channels & Ties, 363—Flexible Gripstay™ Anchor, www.h-b.com, © 2013-2017 MiTek, (1) pg.
Hohmann & Barnard, Inc., Ties & Anchors—Miscellaneous, VBT—Vee Byna-Tie®, www.h-b.com, © 2013-2017 MiTek, (1) pg.
Hohmann & Barnard, Inc., Dovetail Anchors, Slots & Ties, 315—Flexible Dovetail Brick Tie, www.h-b.com, © Hohmann & Barnard, Inc.—2013, (1) pg.
Hohmann & Barnard, Inc., Ties & Anchors—Miscellaneous, 345-BT Flexible Tie, www.h-b.com, © Hohmann & Barnard, Inc.—2012, (1) pg.

* cited by examiner

FACADE SUPPORT SYSTEM

FIELD OF THE INVENTION

The present invention generally relates to a facade support system used in building construction, and more specifically, to a veneer tie used to connect an outer wythe to an inner wythe of a wall.

BACKGROUND

A facade can be a durable and aesthetically desirable construction for a building exterior. Facades, such as brick or stone veneer walls, also provide protection to the interior of the building from the surrounding environment. Anchoring systems, such as veneer ties, are used to secure facades to inner walls of a building to overcome forces which might pull the facade away from the building. These anchoring systems extend from the inner wall of the building to the facade. Generally, anchoring systems, such as veneer ties are connected to the inner wythe with a fastener. The fastener is inserted through an opening in the veneer tie and secured to the inner wythe thereby compressing the veneer tie against the inner wythe.

SUMMARY

In one aspect, a veneer tie for use in a wall to join an inner wythe and an outer wythe of the wall where the outer wythe is formed from a plurality of successive courses of masonry units with a mortar-filled bed joint between each two adjacent courses. The veneer tie includes an attachment portion and an insertion portion. The attachment portion has a bent loop defining an opening configured to receive a fastener to secure the attachment portion to the inner wythe and a circumferential gap located on the loop. The gap has a width that is less than a width of the opening. The insertion portion is fixed to the attachment portion and extends in a direction transverse of the attachment portion. The insertion portion is configured for disposition in the bed joint.

In another aspect, a veneer tie for use in a wall to join an inner wythe and an outer wythe of the wall. The outer wythe is formed from a plurality of successive courses of masonry units with a mortar-filled bed joint between each two adjacent courses. The veneer tie comprises a unitary wire formative deformed to include a loop, connecting portions and free end portions. The loop defines an opening sized and shaped for receiving a fastener therethrough to connect the veneer tie to the inner wythe. The loop includes a circumferential gap, the gap being narrower than the opening. The connecting portions extend from the loop on opposite sides of the circumferential gap, and the free end portions are located at respective ends of the connection portions. The free end portions extend in a direction parallel to the loop and converge toward each other away from the connecting portions.

DESCRIPTION OF THE PREFERRED EMBODIMENT

Figure 1:
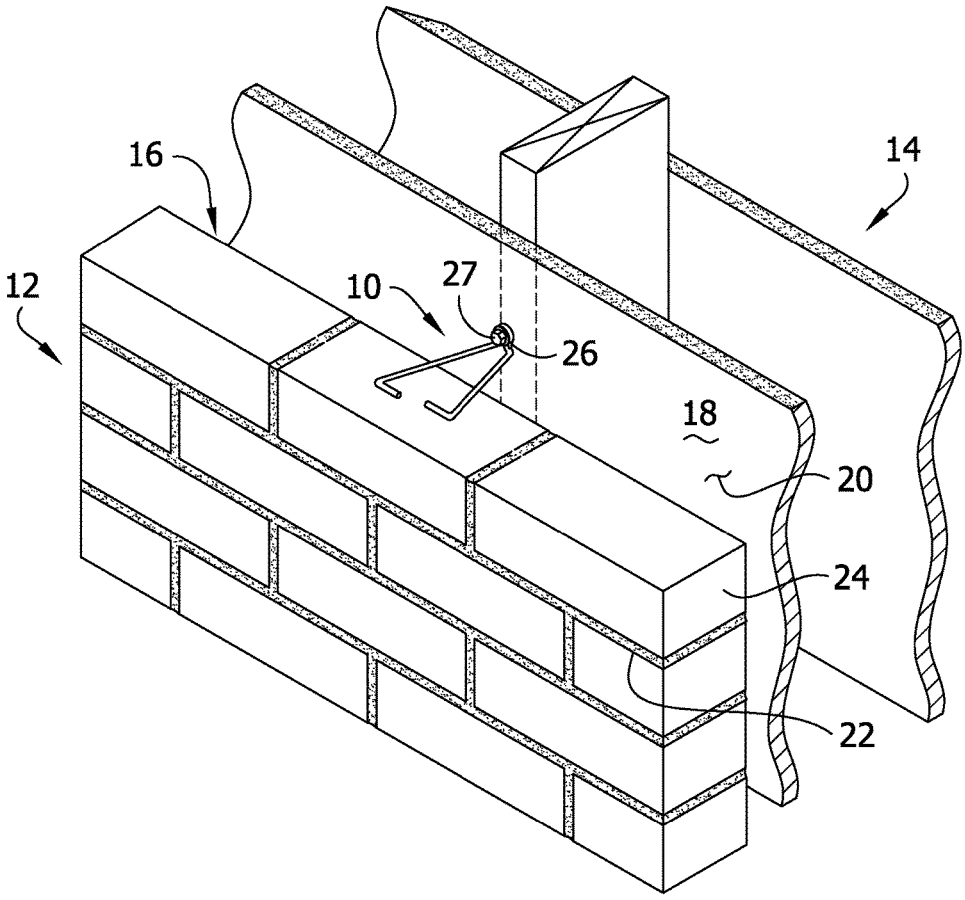
FIG. 1 is a perspective view of the first embodiment of a veneer tie connecting an outer wythe to a stud frame inner wythe.

Referring to FIG. 1, the first embodiment of a veneer tie connecting an outer wythe 12 to an inner wythe 14 of a building is shown generally at 10. In this embodiment, a masonry wall structure is shown having the inner wythe 14 of stud frame construction including a stud and wall members on either side of the stud. The veneer or outer wythe 12 is shown as being of brick construction. The outer wythe 12 has an interior surface or side 16. The inner wythe 14 has an exterior surface or side 18 defined by the outer of the two wall members. The side 18 of the inner wythe 14 faces and is spaced from the interior surface 16 of the outer wythe 12. The inner wythe 14 may also be of concrete construction (not shown). Between the inner wythe 14 and outer wythe 12, a cavity 20 is formed separating the inner wythe 14 and outer wythe 12. It is to be understood that the inner and outer wythes may have other constructions than described herein that are within the scope of the present invention.

The outer wythe 12 has successive bed joints 22 filled with mortar formed between courses of bricks 24 and are substantially planar and horizontally disposed. The bed joints 22 are specified as to the height or thickness of the mortar layer and the thickness specification is adhered to so as to provide the requisite uniformity for quality construction. In accordance with building standards, the bed joints 22 are approximately 0.375 inches (0.9525 cm) in height in a typical embodiment. However, bed joints 22 of different heights are within the scope of the present invention. Select bed joints 22 receive a veneer tie 10 which extends from the bed joint 22 across the cavity 20 and engages an interior surface 18 of the inner wythe 14. The veneer tie 10 is secured to the exterior surface 18 of the inner wythe 14 with a fastener 26. In this way the veneer tie 10 anchors the outer wythe 12 to the inner wythe 14. The veneer tie 10 is made from a single piece of metal, such as steel or aluminum, or other suitable material.

Figure 2:
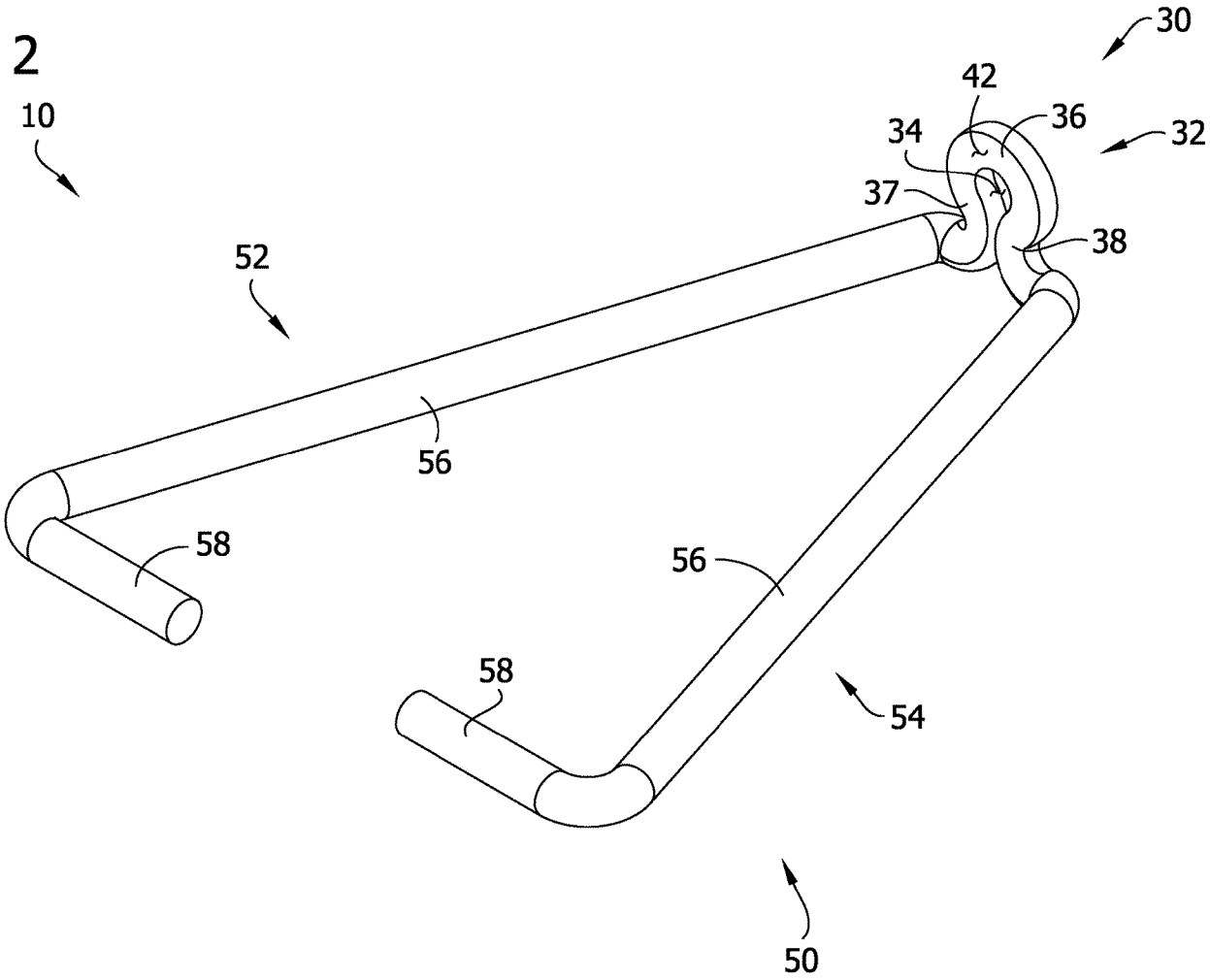
FIG. 2 is a front perspective view of the first embodiment of the veneer tie.
Figure 3:
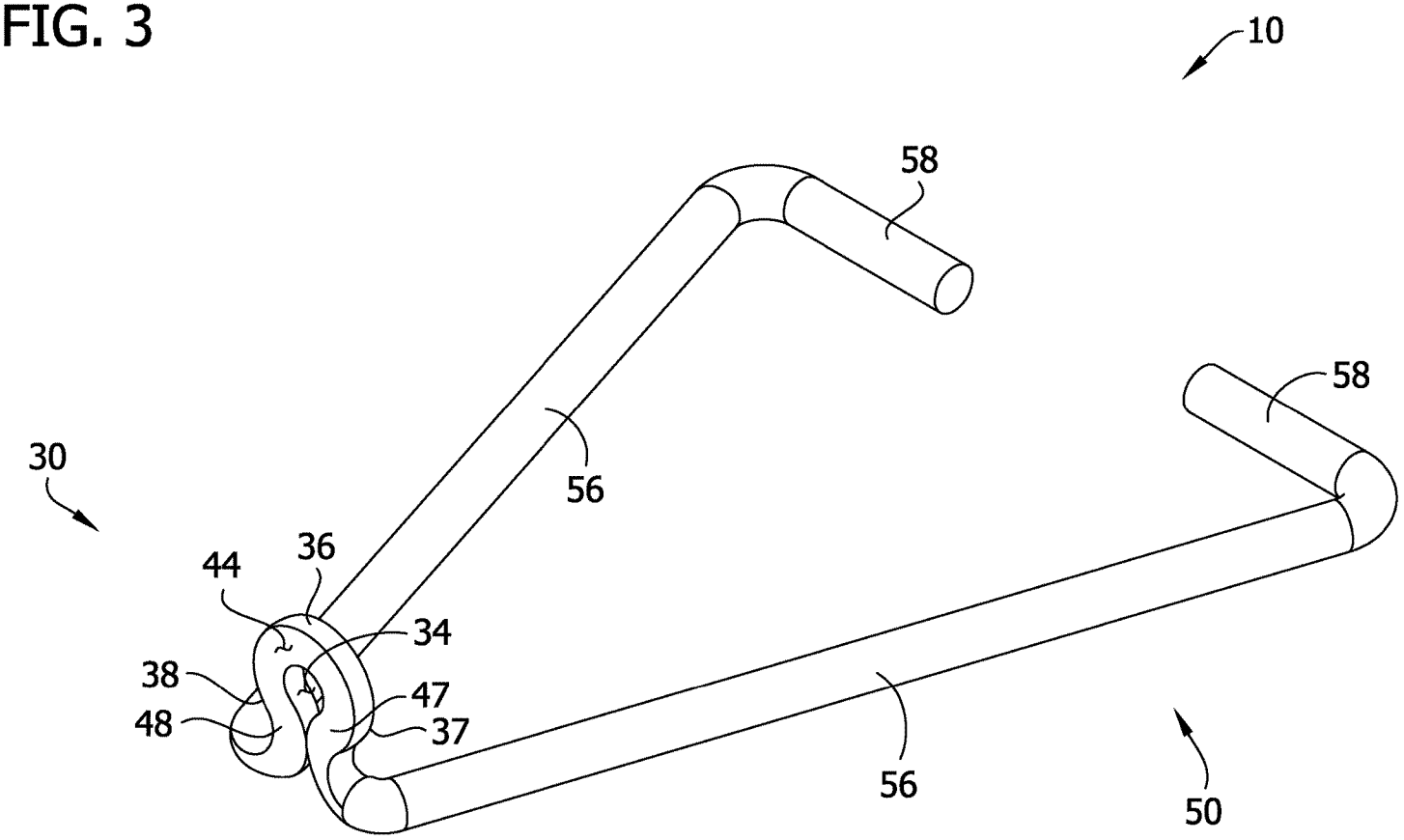
FIG. 3 is a rear perspective view thereof.
Figure 5:
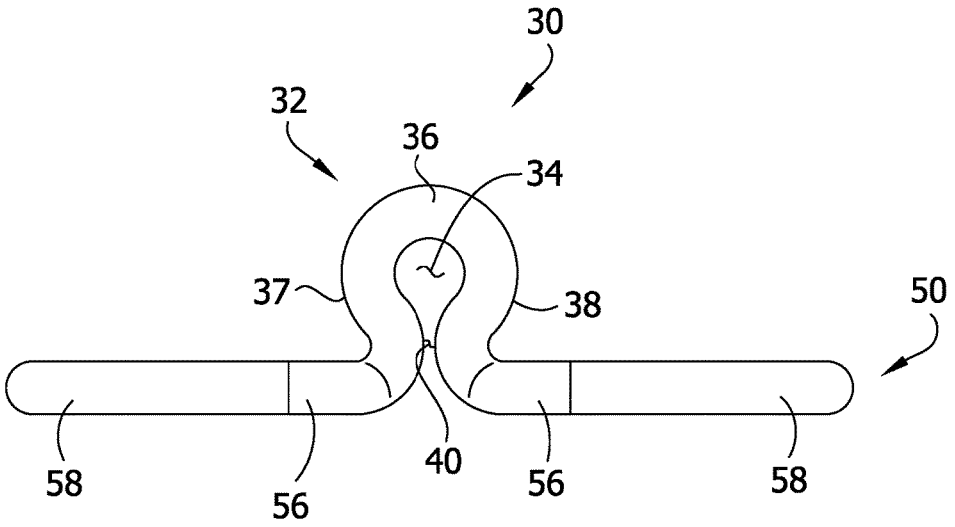
FIG. 5 is a front view thereof.
Figure 6:
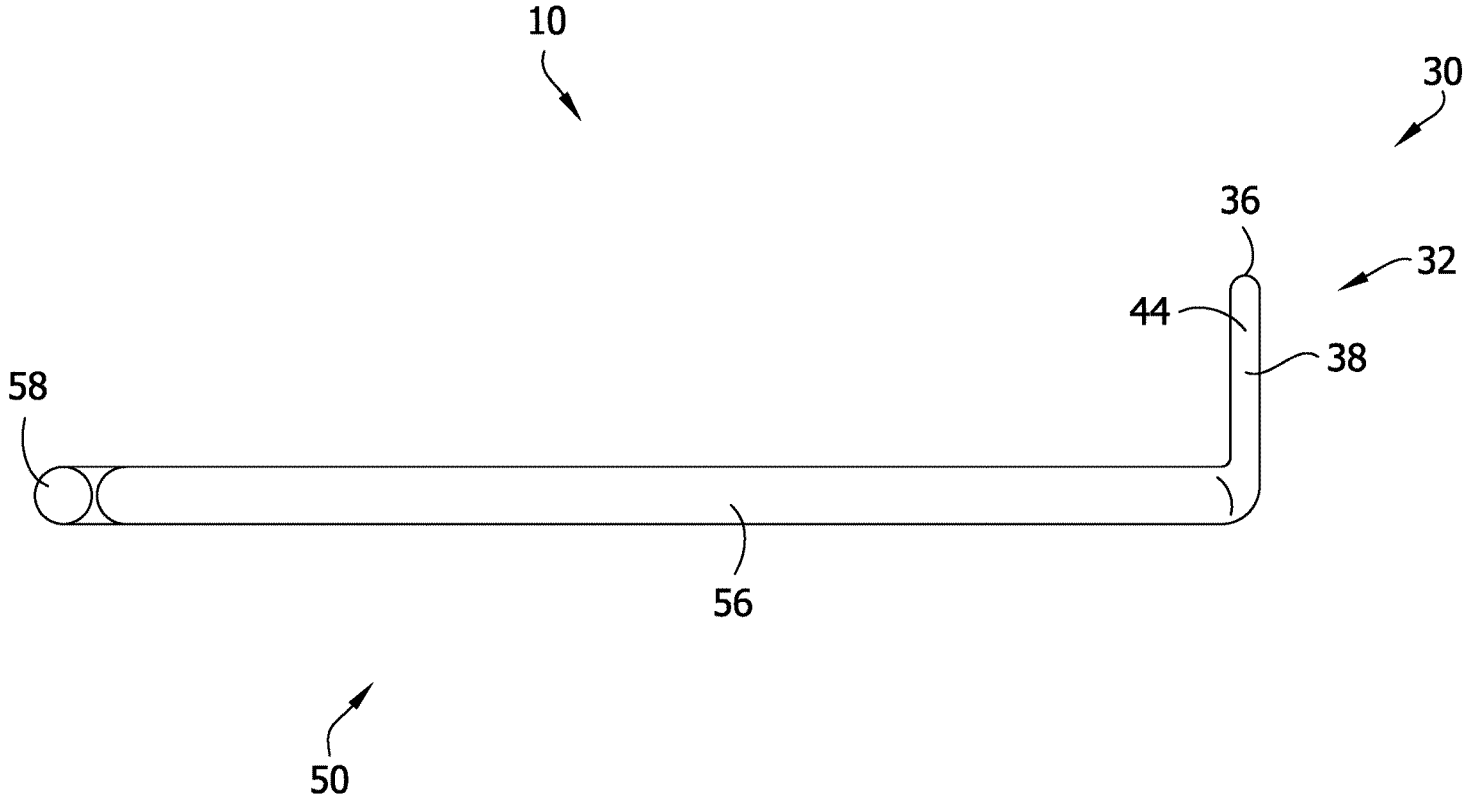
FIG. 6 is a side view thereof.
Figure 7:
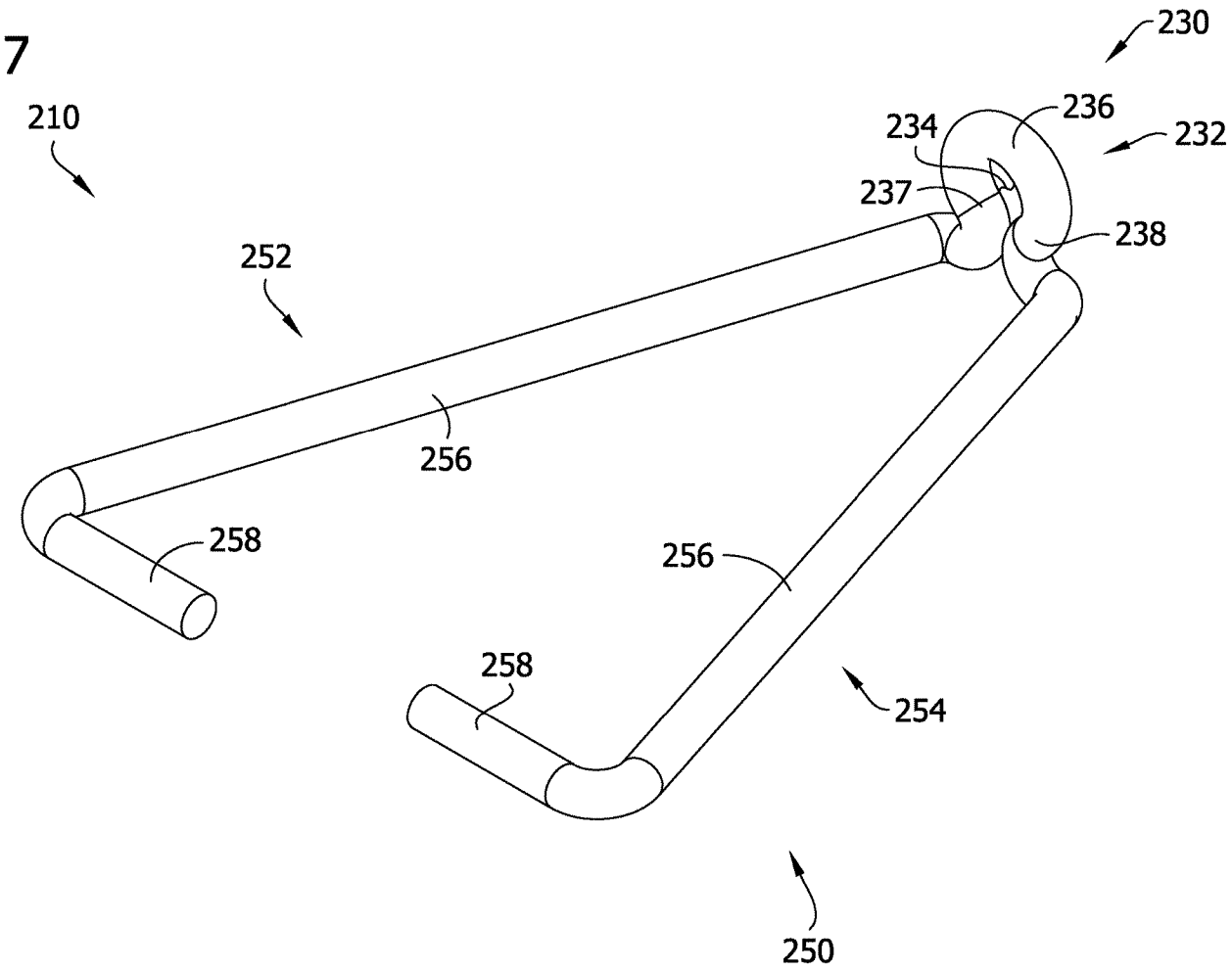
FIG. 7 is a front perspective view of the second embodiment of the veneer tie.
Figure 8:
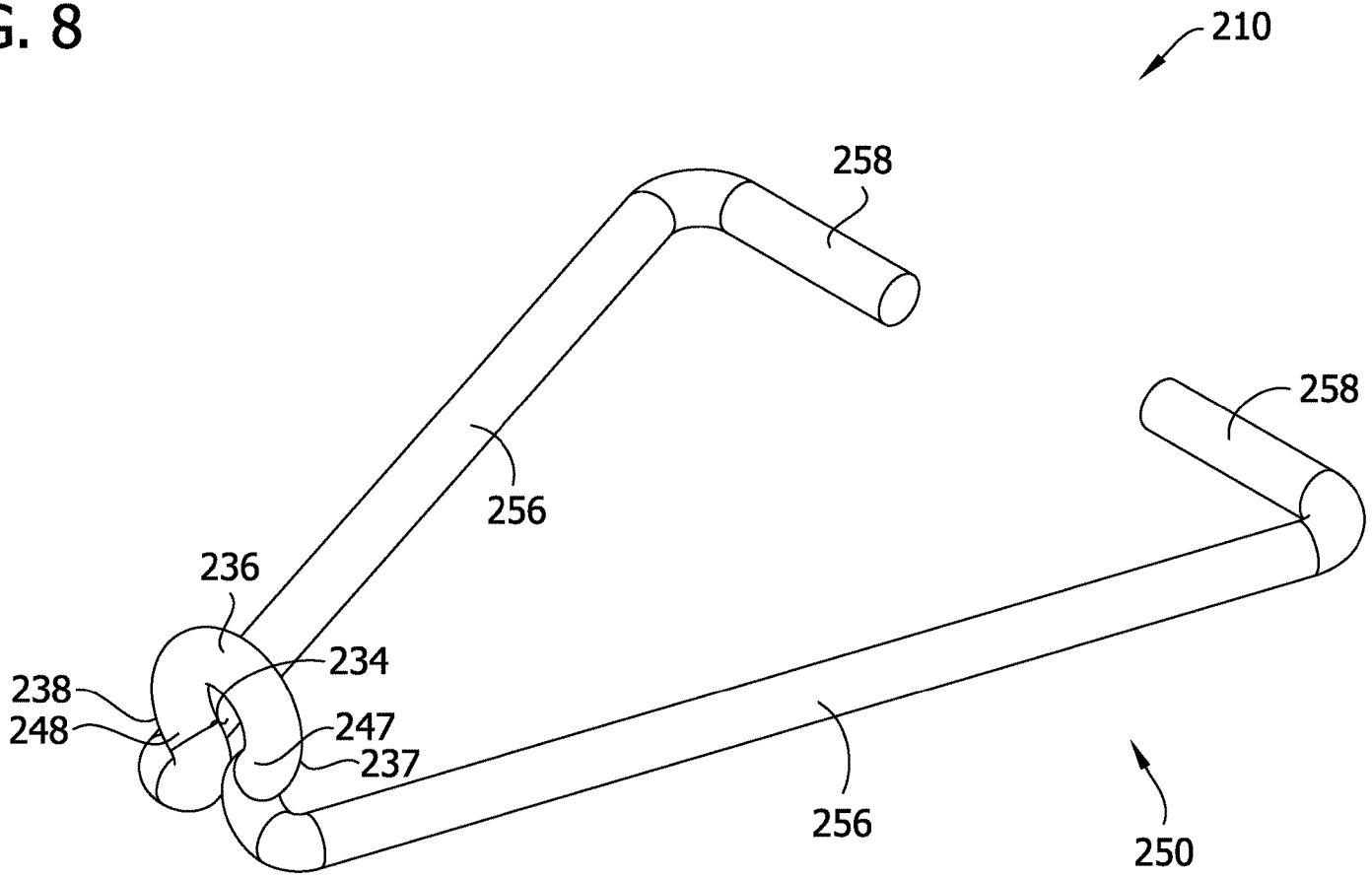
FIG. 8 is a rear perspective thereof.
Figure 9:
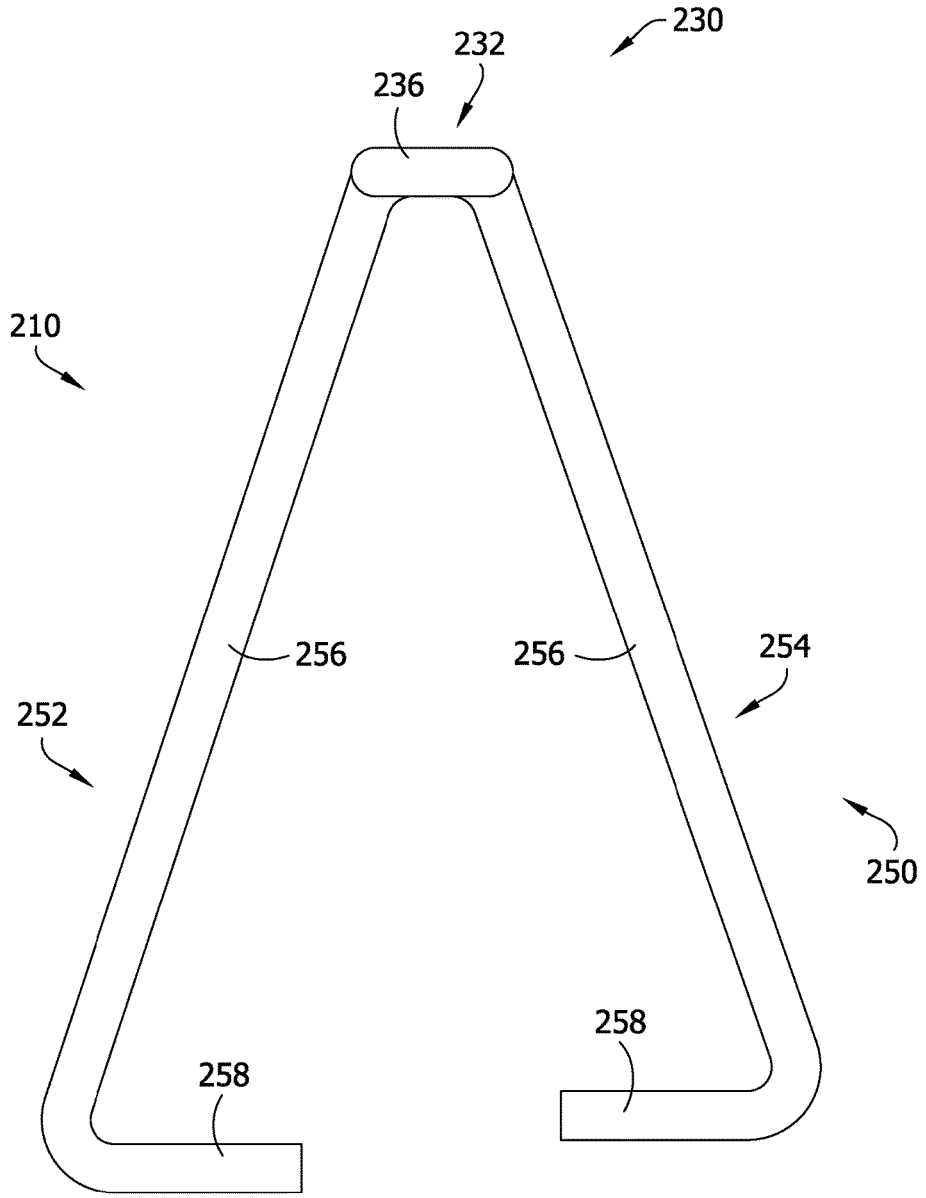
FIG. 9 is a top view thereof.
Figure 10:
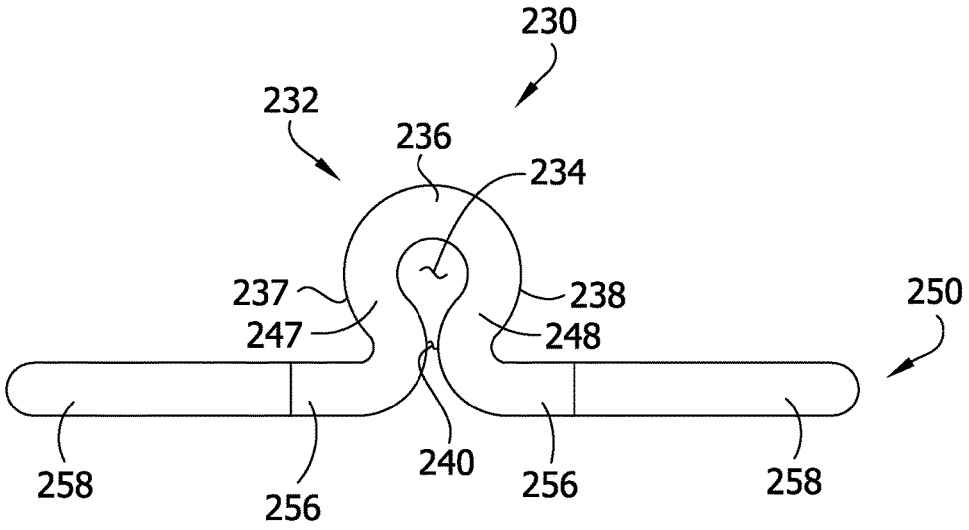
FIG. 10 is a front view thereof.
Figure 11:
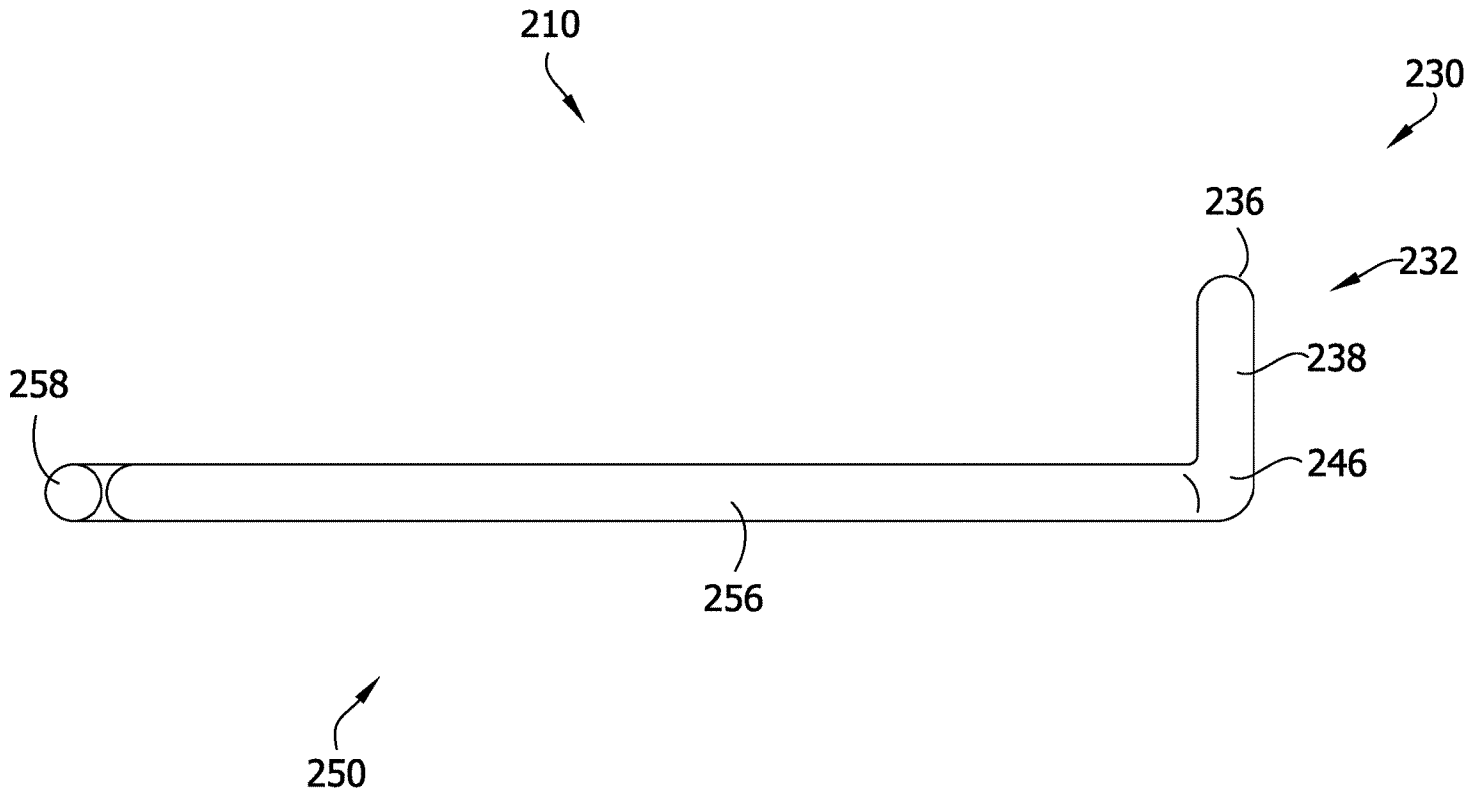
FIG. 11 is a side view thereof.

As shown in FIG. 2, the veneer tie 10 is a one-piece wire formative which is formed to define an attachment portion 30 and an insertion portion 50. The attachment portion 30 includes a loop 32 bent to define an elongate opening 34 therein. As shown in FIG. 1, the opening 34 is sized and shaped to receive a fastener 26. The loop 32 has a generally donut shape with an arch portion 36 defining the top of the opening 34 and two leg portions 37 and 38 that extend from the arch portion 36 on opposite sides of the opening 34. Each leg portion 37, 38 has a first end connected to the arch portion 36 and a second end spaced apart from the first end. The leg portions 37, 38 are non-parallel and converge toward one another as they extend from the arch portion 36. In the illustrated embodiment, the leg portions 37, 38 do not come into contact with each other. Thus, a circumferential discontinuity or gap 40 on the loop 32 is defined by the second ends of each leg portion 37,38. The leg portions 37, 38 could come into contact with each other. However, even if there was no gap 40, there would be a discontinuity of the material defining the opening 34. The circumferential gap 40 is located opposite or across the opening 34 from the arch portion 36. Because each leg portion 37, 38 converges toward the other leg portion, the width of the circumferential gap 40 is narrower than the width or diameter of the opening 34. More specifically, referring to FIG. 5, the gap 40 at its narrowest point has a width that is less than the maximum width of the opening 34. As shown, the entire gap 40 has a width less than the diameter of the opening 34. The width of the gap 40 could be zero, in which case the gap 40 is broadly considered a discontinuity of the material defining the opening 34. The opening 34 is generally circular for receiving a fastener 26 having a cylindrical shaft (i.e., a threaded cylindrical shaft). However, the lower portion of the opening 34 is elongate, giving the opening a light bulb shape.

In the first embodiment, the attachment portion 30 is compressively reduced forming a flat front surface 42 and a flat back surface 44 opposite the flat front surface 42 on the loop 32. The flat front surface 42 and the flat back surface 44 are generally parallel to each other. More specifically, the entire loop 32, including the arch portion 36 and two leg portions 37, 38, are compressively reduced such that the flat front surface 42 and flat back surface 44 are located on the arch portion and two leg portions. However, only part or none of the attachment portion may be compressively reduced without departing from the scope of the present invention. The flattened attachment portion 30, allows the head 27 of the fastener 26 to make contact with the attachment portion over a greater area. As shown in FIG. 2, the insertion portion 50 is free of compressive reduction, however, such a configuration is contemplated and within the scope of the present invention.

The insertion portion 50 of the veneer tie is fixed to the attachment portion 30 adjacent to the circumferential gap 40. The insertion portion 50 extends in a direction transverse of the attachment portion 30. As shown in FIG. 1, the insertion portion 50 is generally perpendicular to the attachment portion 30 and extends across the cavity 20 to a bed joint 22 in the outer wythe 12. Thus, the attachment portion 30 may lie flat against the inner wythe 14 while the insertion portion 50 extends horizontally to the outer wythe 12.

Figure 4:
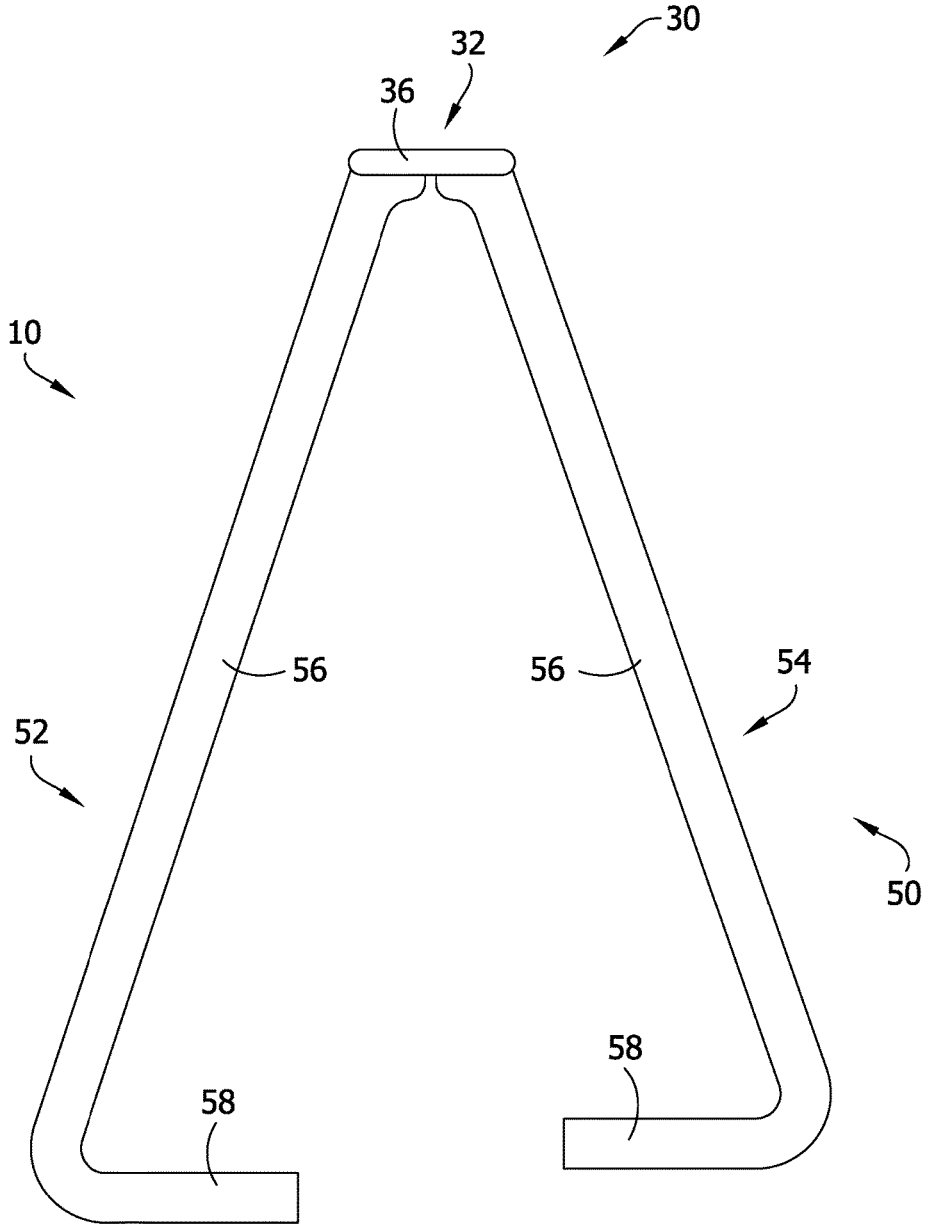
FIG. 4 is a top view thereof.

The insertion portion 50 includes a first segment 52 and a second segment 54. The first segment 52 projects from the attachment portion 30 on one side of the loop 32 adjacent to the gap 40 and the second segment 54 projects from the attachment portion on the other side of the loop adjacent to the gap. The first and second segments 52, 54 each include a connecting portion 56 and a free end portion 58. Each connecting portion 56 has a proximal end and a distal end. The proximal end of each connecting portion 56 is secured to the attachment portion 30. More specifically, the proximal end of each connecting portion 56 is fixed to the loop 32 of the attachment portion 30 on opposite sides of the circumferential gap 40. In this manner, each connecting portion 56 extends from the second end of a respective leg portion 37, 38 at a generally perpendicular angle to the attachment portion 30. As best shown in FIG. 4, each connecting portion 56 extends in the same general direction but at different angles. In this manner, the connecting portions 56 of the first and second segments 52, 54 diverge from each other as they extend from the attachment portion 30. Thus, each connecting portion 56 lies in the same horizontal plane but in a non-parallel configuration relative to one another.

The free end portions 58 of the first and second segments 52, 54 extend toward each other from the distal end of each connection portion 56. Each free end portion 58 extends from the corresponding connecting portion 56 at an angle relative to the connecting portion 56. The two free end portions 58 are generally parallel to each other and to the inside surface of the outer wythe 16. Thus, the free end portions 58 extend in a direction that is parallel to the loop 32.

As shown in FIG. 4, the lengths of each connecting portion 56 can be different. The two free end portions 58 are equal in length and extend toward each other but do not overlap. A veneer tie 10 having two connection portions 56 of equal lengths or two free end portions 58 of unequal and/or overlapping lengths is also contemplated. The free end portions 58 extending at other angles relative to the connection portions 56 is also contemplated. In the illustrated embodiments, the wire formative is made as a single piece of material and bent into the shape shown.

A fastener 26 is used to secure the veneer tie 10 to the inner wythe 14. When the fastener 26 is inserted into the opening 34 of the veneer tie 10, the attachment portion 30 is generally parallel to the exterior surface 18 of the inner wythe 14. A head 27 of the fastener 26 compresses the attachment portion 30 against the exterior surface 18 of the inner wythe 14, securing the veneer tie 10 to the inner wythe 14. The flat back surface 44 comes into surface to surface contact with the exterior surface 18 of the inner wythe 14. Because the front surface 42 is flat, there is no need to use a washer between the fastener head 27 and the loop 32 to distribute the compressive force the head 27 of the fastener 26 places on the loop 32. Similarly, the flat back surface 44 provides more surface to surface contact with the inner wythe 14 which distributes the force the loop 32 exerts on the inner wythe 14 over a greater area. Distributing the force over a greater area provides a connection with greater resistance to movement. The greater force distribution also reduces the likelihood of the attachment portion 30 damaging the exterior surface 18 of the inner wythe when the attachment portion 30 is compressed by the fastener 26.

When inserted into the outer wythe 12, the insertion portion 50 is in a substantially horizontal plane with the bed joint 22. The two connecting portions 56 extend from the attachment portion 30 across the cavity 20 and into the bed joint 22. The two free end portions 58 and a part of the connecting portions 56 are surrounded by the mortar and secured within the bed joint 22. The angle of the free end portion 58 to the connection portion 56 resists the veneer tie 10 from being pulled out of the bed joint 22.

Referring to FIGS. 7-11, a second embodiment of the veneer tie 210 is disclosed. For ease of comprehension, where analogous parts are used, reference designators "200" units higher are employed. Thus, the veneer tie 210 of the second embodiment is analogous to the veneer tie 10 of the first embodiment. The veneer tie 210 of the second embodiment is the same as the veneer tie 10 of the first embodiment as described above, except the attachment portion 230 of the veneer tie of the second embodiment is not compressively reduced. Thus, the veneer tie 210 maintains its wire formative shape and does not require the extra manufacturing step of compressively reducing the attachment portion 230.

A fastener 26 is used to secure the veneer tie 210 to the inner wythe 14. When the fastener 26 is inserted into the opening 234 of the veneer tie 210, a head 27 of the fastener 26 compresses the attachment portion 230 against the exterior surface 18 of the inner wythe 14. Because the attachment portion 230 is a wire formative shape, a washer (not shown) is disposed between the head 27 of the fastener 26 and the attachment portion 230 to distribute the compressive force the head 27 places on the attachment portion 230. The fastener 26 securing the veneer tie 210 to the inner wythe 14 without the use of a washer is within the scope of the present invention. Otherwise, the veneer tie 230 is secured to the inner and outer wythe 14, 12 as described above in the first embodiment.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A veneer tie for use in a wall to join an inner wythe and an outer wythe of the wall, the outer wythe formed from a plurality of successive courses of masonry units with a mortar-filled bed joint between each two adjacent courses, the veneer tie comprising:

an attachment portion including a bent loop defining an opening configured to receive a fastener to secure the attachment portion to the inner wythe and a circumferential discontinuity located on the loop, the discontinuity having a width that is less than a width of the opening; and an insertion portion fixed to the attachment portion and extending in a direction transverse of the attachment portion, the insertion portion being configured for disposition in the bed joint, wherein the attachment portion is compressively reduced.

2. The veneer tie of claim 1, wherein the veneer tie comprises a wire formative that is formed to define the attachment portion.

3. The veneer tie of claim 2 wherein the wire formative defines the insertion portion.

4. The veneer tie of claim 3 wherein the wire formative is made of a single piece of material.

5. The veneer tie of claim 3 wherein the insertion portion further comprises a connecting portion and a free end portion, the connecting portion connecting the free end portion to the attachment portion adjacent to the discontinuity.

6. The veneer tie of claim 5 wherein the insertion portion is perpendicular to the attachment portion.

7. The veneer tie of claim 3 wherein the insertion portion comprises a first segment of the wire formative projecting from the attachment portion on one side of the loop and a second segment of the wire formative projecting from the attachment portion on an opposite side of the loop.

8. The veneer tie of claim 7 wherein the first and second segments diverge from each other away from the attachment portion.

9. The veneer tie of claim 8 wherein free end portions of the first and second segments extend toward each other.

10. The veneer tie of claim 1 wherein the insertion portion and the attachment portion are formed as one piece of material.

11. The veneer tie of claim 9 wherein the entirety of the attachment portion forming the loop is compressively reduced.

12. The veneer tie of claim 1 wherein the insertion portion is free of compressive reduction.

13. A veneer tie for use in a wall to join an inner wythe and an outer wythe of the wall, the outer wythe formed from a plurality of successive courses of masonry units with a mortar-filled bed joint between each two adjacent courses, the veneer tie comprising a unitary wire formative deformed to include:

a loop defining an opening sized and shaped for receiving a fastener therethrough to connect the veneer tie to the inner wythe, the loop including a circumferential discontinuity, the discontinuity being narrower than the opening;

connecting portions extending from the loop on opposite sides of the circumferential discontinuity in the loop; and free end portions located at respective ends of the connection portions, the free end portions extending in a direction parallel to the loop and converging toward each other away from the connecting portions, wherein the loop is compressively reduced.

14. The veneer tie of claim 13 wherein the opening defined by the loop is elongate.

15. The veneer tie of claim 14 wherein the loop comprises an arch portion and leg portions extending from the arch portion.

16. The veneer tie of claim 15 wherein the leg portions are in a non-parallel configuration.

17. The veneer tie of claim 16 wherein the leg portions converge toward one another as they extend from the arch portion to the discontinuity.

18. The veneer tie of claim 13 wherein the entirety of the loop is compressively reduced.

* * * * *